US005127595A

United States Patent [19]

Tone

[11] Patent Number: 5,127,595

[45] Date of Patent: Jul. 7, 1992

[54] INSPECTION PROCESS FOR SPLICER

[75] Inventor: Shoichi Tone, Kyoto, Japan

[73] Assignee: Murata Kikai Kabushiki Kaisha, Kyoto, Japan

[21] Appl. No.: 479,118

[22] Filed: Feb. 13, 1990

[30] Foreign Application Priority Data

Feb. 15, 1989 [JP] Japan ..... 1-33774

[51] Int. Cl.[5] ..... B65H 54/22; B65H 63/00

[52] U.S. Cl. ..... 242/35.6 R; 242/36; 57/22

[58] Field of Search ..... 242/35.5 R, 35.6 R, 242/36; 57/22

[56] References Cited

U.S. PATENT DOCUMENTS

| | | | |
|---|---|---|---|
| 1,516,885 | 11/1924 | Houghton | 242/154 |
| 2,716,429 | 12/1950 | Gingher | 242/154 |
| 3,966,133 | 6/1976 | Gelin | 242/45 X |
| 4,007,457 | 2/1977 | Aeppli | 242/36 X |
| 4,432,197 | 2/1984 | Ueda et al. | 57/22 X |
| 4,437,299 | 4/1984 | Truzzo et al. | 57/22 |
| 4,733,829 | 3/1988 | Mima | 242/35.6 R |
| 4,805,846 | 2/1989 | Ueda et al. | 242/36 |

FOREIGN PATENT DOCUMENTS

| | | | |
|---|---|---|---|
| 878618 | 8/1949 | Fed. Rep. of Germany | 242/154 |

*Primary Examiner*—Stanley N. Gilreath
*Attorney, Agent, or Firm*—Spensley Horn Jubas & Lubitz

[57] ABSTRACT

There is provided a process for inspecting a splicer provided for splicing yarn ends upon the occurrence of yarn breakage or the like in an automatic winder, the process comprising the steps of, after splicing yarn ends, taking up the spliced yarn at a low speed and restraining the yarn on the yarn supply side to impart a predetermined tension to the yarn, detecting whether yarn breakage indicative of malfunction of the splicer has occurred, and, if the yarn breakage indicative of malfunction of the splicer has not occurred, cutting the spliced yarn, and re-splicing the yarn ends of the yarn thus cut.

10 Claims, 5 Drawing Sheets

INSPECTION PROCESS FOR SPLICER

FIELD OF THE INVENTION

This invention relates to a process for inspecting a splicer, and more particularly to a process for inspecting the operation of a splicer provided for an automatic winder.

RELATED ART STATEMENT

In general, an automatic winder for rewinding a yarn detects the condition of the yarn being fed and, upon the occurrence of yarn breakage or the like, automatically splices the broken ends of the yarn.

As shown in FIG. 6, this type of automatic winder according to the prior art comprises a traverse drum 3 driven to make contact with a take-up package 2 so as to draw upward and take up a yarn Y from a spinning bobbin 1, and also comprises a balloon breaker 4, a tenser 5 for imparting an appropriate tension to the yarn Y, a slub catcher 6 serving as a yarn defect detector, and a splicer 7 serving as a splicing device, which are arranged in that order from the yarn supply side. The automatic winder is provided with a controller 8 for operating these components appropriately in conjunction with each other. The controller 8 outputs an electric signal for operating a cutter 9 immediately upon the detection by the slub catcher 6 of a defect in the yarn Y passing therethrough, and outputs an instruction signal to the splicer 7 so as to join the cut ends of the yarn Y, whereby the yarn ends are spliced to each other.

When the yarn is cut by the cutter 9, the slub catcher 6 senses the yarn breakage, and, based on information on the condition, the controller 8 stops a driving motor 11 for the traverse drum 3 through an inverter 10. Immediately upon completion of the splicing, the traverse drum 3 is rotated to restart the normal take-up operation.

Conventionally, the above-mentioned automatic winder has not been provided with means for inspecting the splicer 7. Namely, it has been the common practice to regard the splicing as satisfactory, in so far as the splicer 7 is operating, and to continue the operation.

Therefore, there has been the problem that even a yarn not spliced securely may be taken up as it is, resulting in yarn breakage in the subsequent processes.

To solve the problem, arranging a device for pulling the spliced portion of a yarn to inspect the spliced condition may be contemplated. In that case, however, pulling of the yarn Y would slacken the yarn, causing a new yarn breakage. Also, arrangement of an inspecting device separately from the conventional automatic winder leads to a complicated operation control and to an enlargement of the space required for the automatic winder unit.

OBJECT AND SUMMARY OF THE INVENTION

In consideration of the circumstances mentioned above, this invention has been made in order to provide a process for inspecting a splicer by which it is possible to inspect the splicer without causing yarn breakage and to utilize a device existing in an automatic winder.

According to this invention, there is provided a process for inspecting a splicer provided for splicing yarn ends upon the occurrence of yarn breakage or the like in an automatic winder, the process comprising the steps of, after splicing yarn ends, taking up the spliced yarn at a low speed and restraining the yarn on the yarn supply side to impart a predetermined tension to the yarn, detecting whether yarn breakage indicative of malfunction of the splicer has occurred, and, if the yarn breakage indicative of malfunction of the splicer has not occurred, cutting the spliced yarn, and resplicing the yarn ends of the yarn thus cut.

The process makes it possible to inspect the splicer without causing a new yarn breakage and without need for providing a separate device.

DETAILED DESCRIPTION OF PREFERRED EMBODIMENT

An embodiment of this invention will now be described while referring to the attached drawings.

Figure 4:
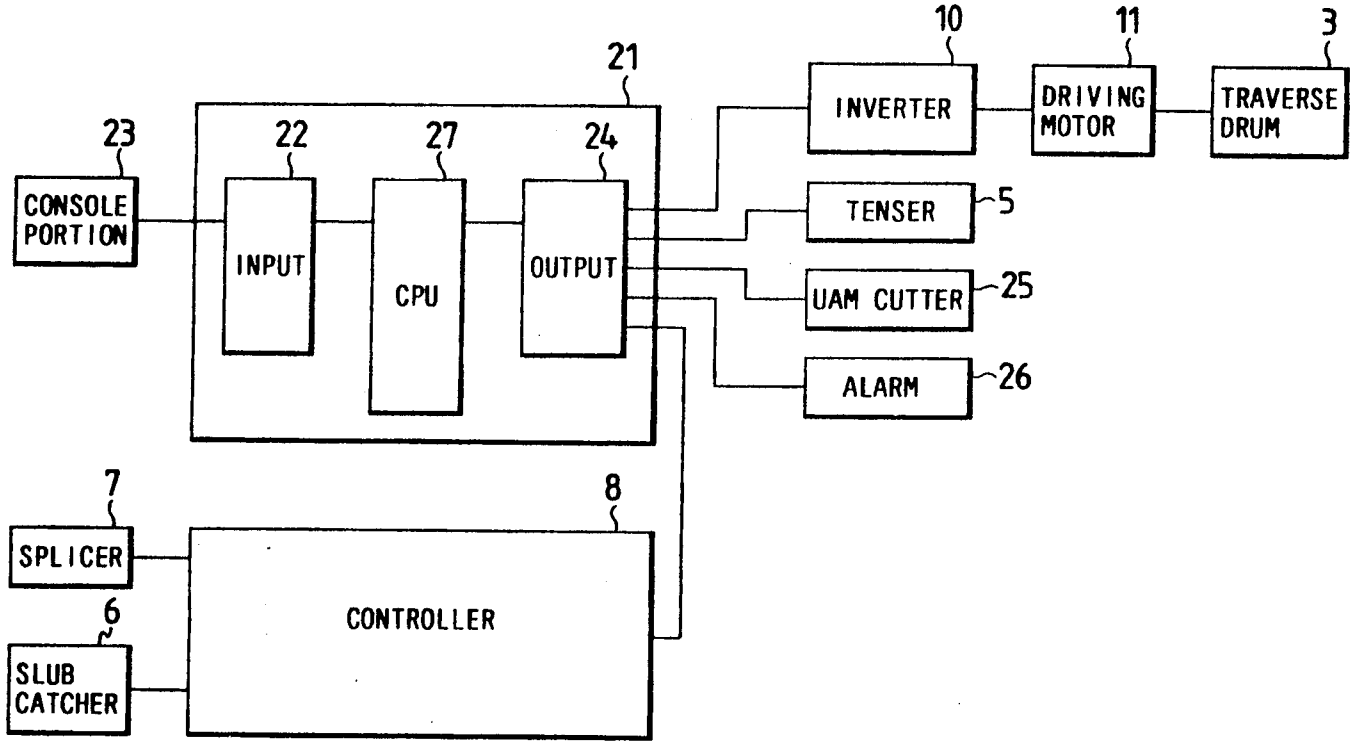
FIG. 4 is a block diagram of one embodiment of an automatic winder according to this invention.
Figure 6:
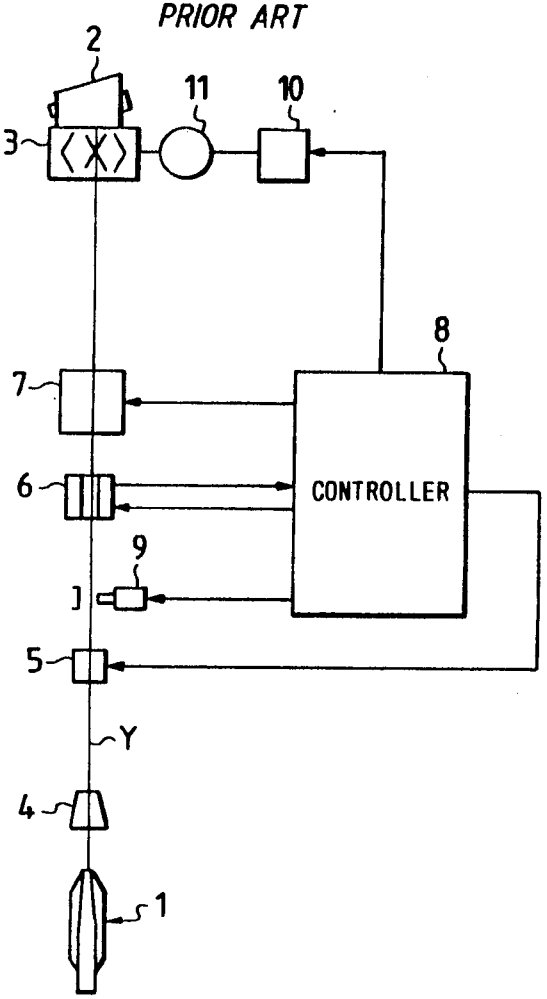
FIG. 6 PRIOR ART
FIG. 6 is a block diagram of an automatic winder according to the prior art.

First, the arrangement of an automatic winder according to one embodiment of the process for inspecting a splicer of this invention will be explained, referring to FIG. 4. In the figure, only an important part of the automatic winder is shown, and the same components as those in the conventional automatic winder mentioned above are assigned the same reference characters as used above.

In the automatic winder, a controller 8 is provided with an inspection control device 21 which incorporates a checking mode for inspection of the splicer 7.

The inspection control device 21 has an input portion 22, which is connected with a console portion 23 for inputting control conditions, and operational data on a slub catcher 6 and the splicer 7 is inputted to the device 21 from the controller 8. An output portion 24 is connected with an inverter 10 for varying the rotating speed of a driving motor 11 for a traverse drum 3, a tenser 5, an UAM cutter 25 (yarn clearer produced by Zellweger Uster) provided for the slub catcher 6, and an alarm 26 operated when malfunction of the splicer 7 is detected. When a checking operation is finished, a signal is supplied to the controller 8 so as to restart the normal take-up operation. A CPU(central processing unit)27 having a checking mode is connected between the input portion 22 and the output portion 24.

Figure 5:
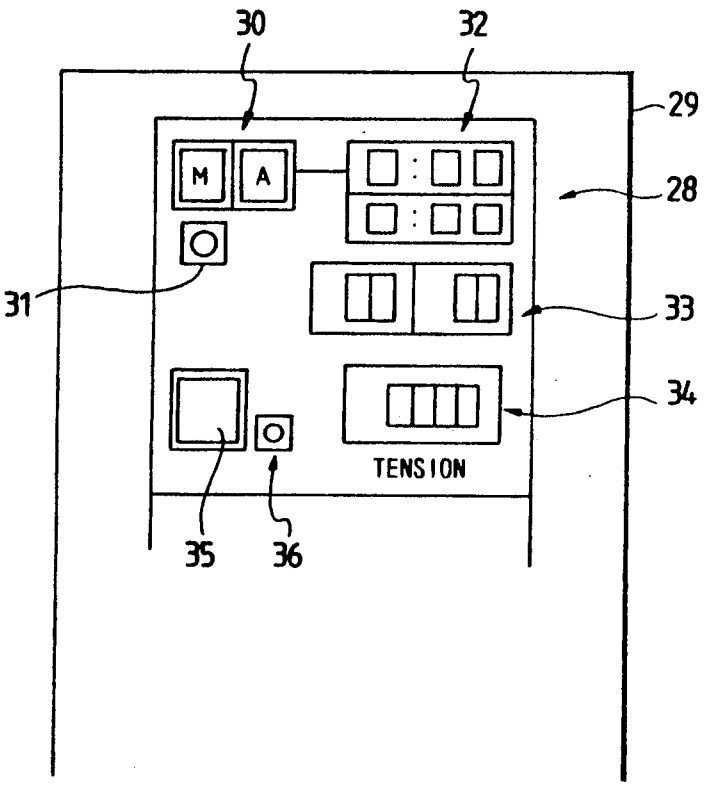
FIG. 5 is a detailed view of an important part of the same.

As shown in FIG. 5, the console portion 23 is provided with a console panel 28 for setting arbitrary control conditions. The console panel 28 is provided on a control unit 29 incorporating the controller 8 and the inspection control device 21, and is capable of being operated simultaneously with the setting of other control conditions, etc. for the automatic winder. The console panel 28 is provided with a changeover switch 30 for selection between "manual" and "auto", a push-button switch 31 for ON/OFF switching in the case of "manual", a timer 32 for setting a checking operation time in the case of "auto", and a counter 33 for counting and setting the number of times of checking. The panel 28 is provided also with a digital switch 34 for setting a tension by varying the pressing force of the tenser 5 according to the kind of the yarn or the like, a lamp 35 of the alarm 26, and an alarm reset switch 36.

Figure 1:
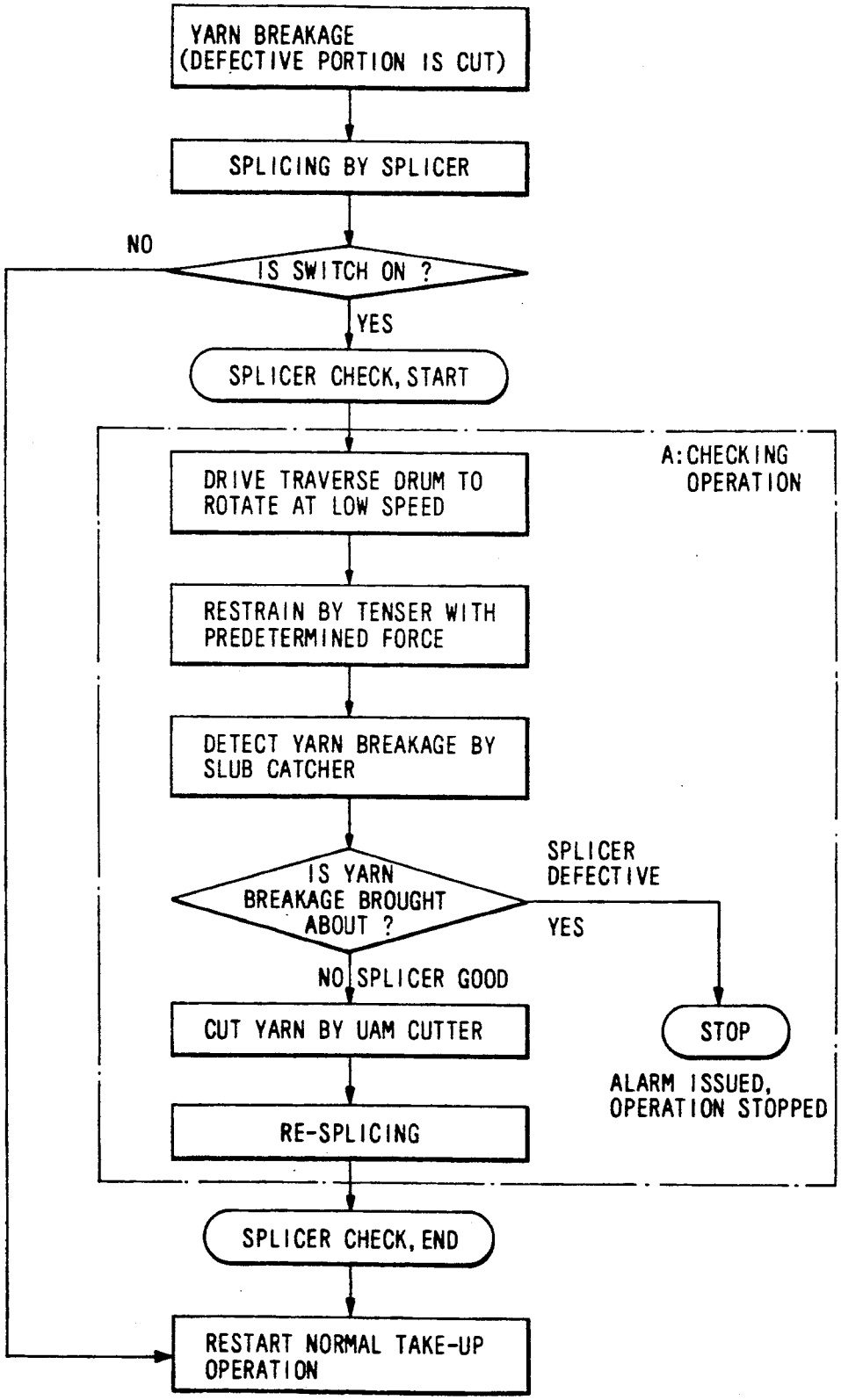
FIG. 1 is a flow chart showing one embodiment of a process for inspecting a splicer according to this invention.

The one embodiment of this invention will now be explained in terms of the operation of the above arrangement.

Where "manual" is selected by the changeover switch 30, as shown in FIG. 1, it is judged whether the push-button switch 31 of the console portion 23 is ON or OFF when splicing is conducted by the splicer 7 after a yarn breakage. If the switch 31 is ON, a checking operation A is carried out according to the checking mode in the inspection control device 21.

In the checking operation A, the traverse drum 3 is started at a low speed and a driving portion (solenoid of electromagnet) of the tenser 5 is operated to give a predetermined tension to the spliced portion of yarn. Under the predetermined tension, the slub catcher 6 checks whether yarn breakage is present.

If the yarn breakage is present, the splicing operation of the splicer 7 is judged as unsatisfactory, the alarm 26 is actuated and the lamp 35 is made to blink, thereby arousing the operator. At the same time, the operation of the automatic winder unit is stopped, followed by repair of the splicer 7, etc.

Figure 2:
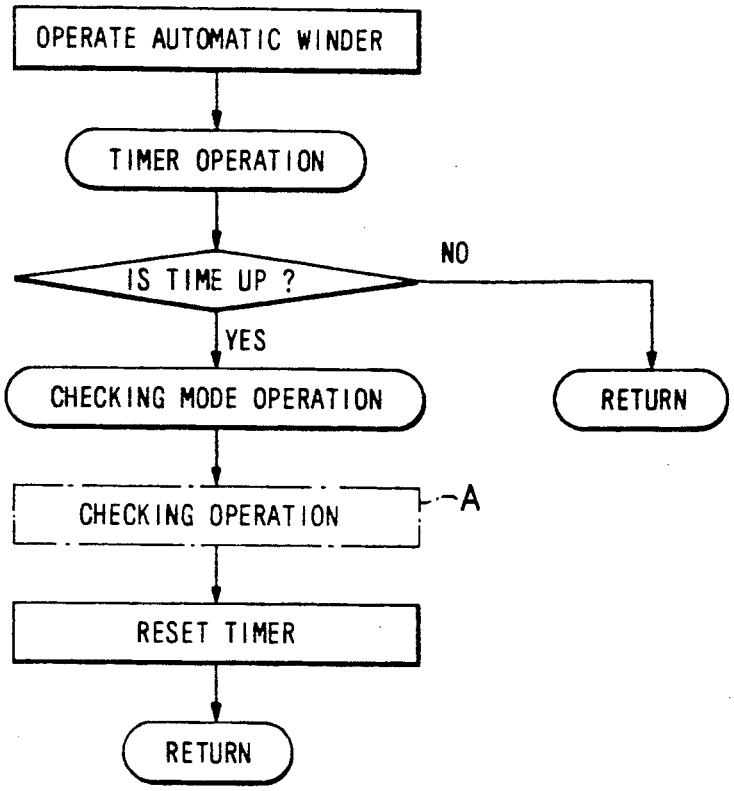
FIG. 2 is a flow chart for automatic inspection.

If the yarn breakage is absent, the yarn Y slackened by the pulling is cut by the UAM cutter 25. The ends of the yarn Y thus cut are again spliced, and the checking operation A is finished. Then, an end signal is supplied to the controller 8, and the normal take-up operation is restarted.

Where "auto" is selected, the timer 32 is set to an arbitrary time. Namely, as shown in FIG. 2, when the set time is up, the checking mode shown in FIG. 1 functions to carry out the checking operation A.

Figure 3:
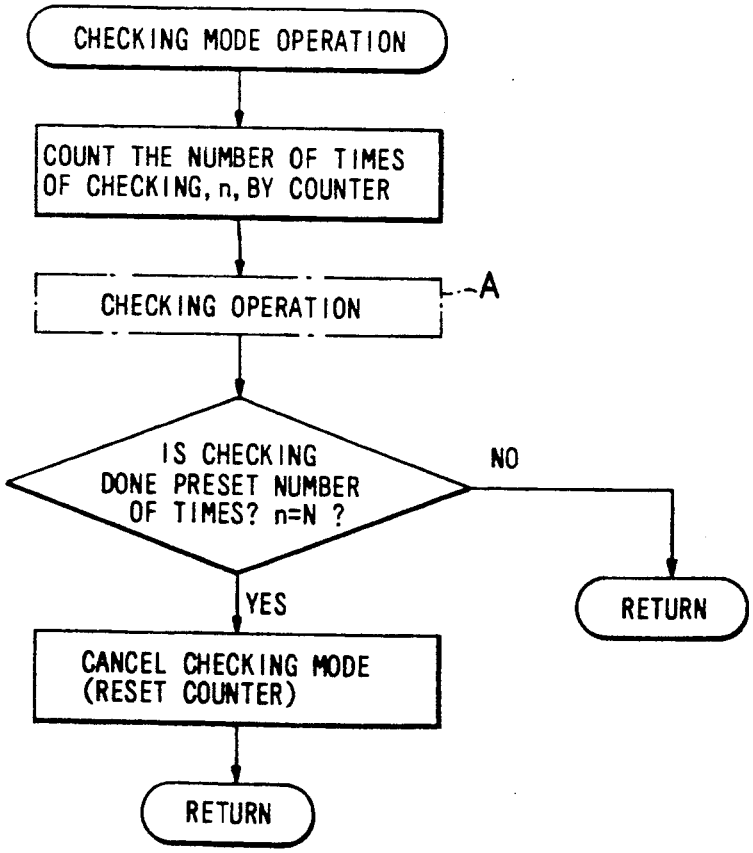
FIG. 3 is a flow chart for the case of carrying out inspection a plurality of times.

The checking operation A may be carried out a plurality of times, successively. Namely, an arbitrary number of times of checking is preliminarily set on the counter 32. As shown in FIG. 3, the counter 32 counts the number of times of checking, n, each time the inspection is carried out under the checking mode, and the checking operation A is repeated the set number of times, N.

Thus, the traverse drum 3 and the tenser 5 are operated so as to cause a yarn breakage procedure upon defective splicing and to cut the yarn upon satisfactory splicing, whereby the yarn portion served to inspection is made sound. It is therefore possible to check the splicing operation of the splicer 7 easily, arbitrarily and securely, and to prevent yarn breakage from occurring in the processes subsequent to the take-up operation.

Furthermore, the process of this invention does not require any additional devices other than the inspection control device 21 provided for the controller 8. Thus, no excessive effect is exerted on the operation control of the automatic winder, and enlarging the space for the automatic winder unit is avoided.

Besides, the checking operation A may be so arranged that the judgment of the splicing as unsatisfactory is not made immediately upon a yarn breakage but is made upon the detection of yarn breakage in, for instance, three out of ten checking operations.

One embodiment of a tenser which may be applied to the apparatus of this invention will be described.

Figure 7:
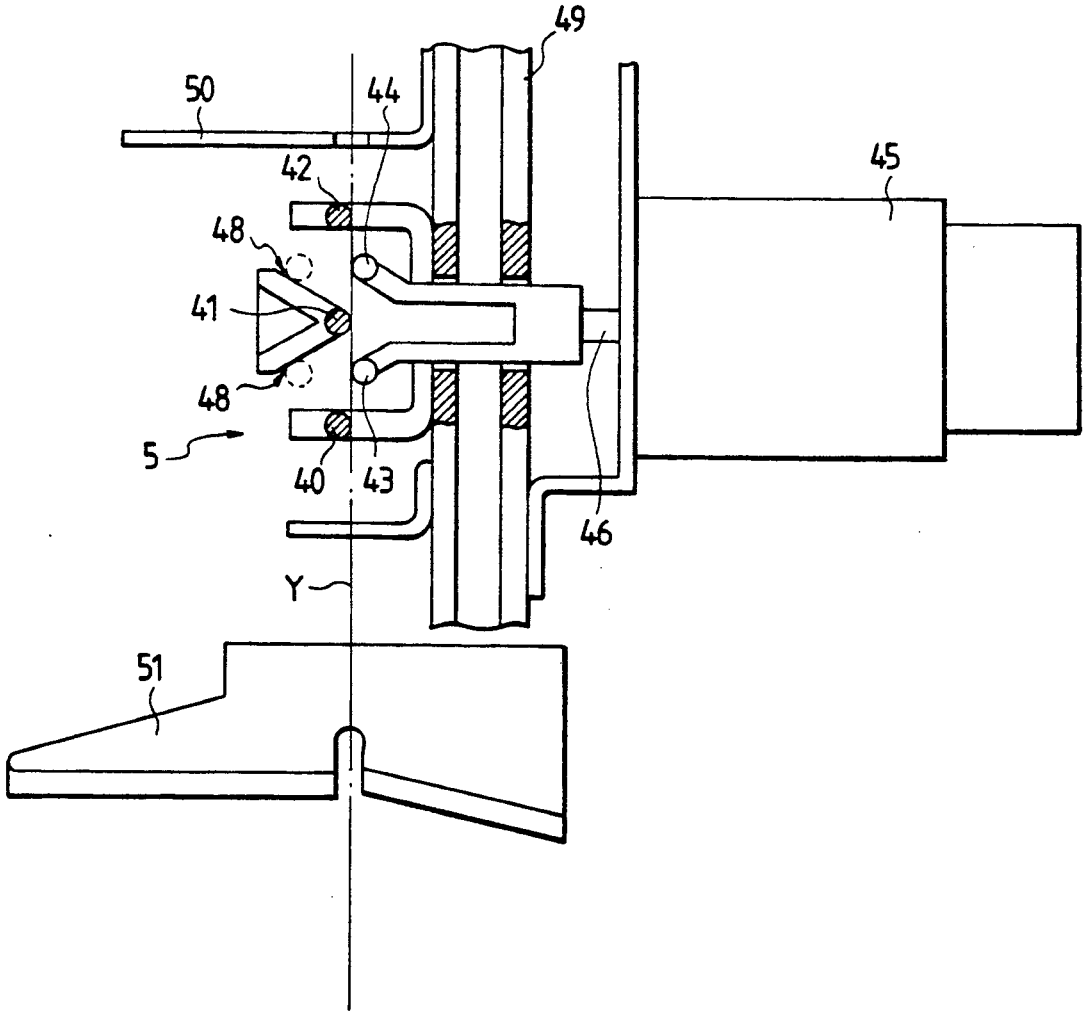
FIG. 7 is a side view partially cut-out showing one embodiment of a tenser applied to the apparatus of this invention.

Referring to FIG. 7, a tenser 5 is disposed along a yarn which is guided by fixed guides 50. 51 which are secured on a fixed bracket 49. The tenser 5 comprises three fixed pins 40, 41 and 42, movable pins 43 and 44 capable of being moved leftward and rightward between the pins 40 and 41 between the pins 41 and 42, respectively, and a solenoid 45 of an electromagnet for driving the movable pins 43 and 44. Though the yarn in the condition shown in FIG. 7 is not tensioned, application of a voltage on the solenoid 45 moves a rod 46 leftward, whereby the movable pins 43 and 44 are each made to come between the fixed pins, and the yarn Y is bent, that is, a tension is imparted to the yarn. The degree of bending of the yarn is determined by the balance between the voltage applied to the solenoid and the tension of the yarn.

In the system as mentioned above, in the checking mode, a set voltage is impressed on the solenoid after the yarn splicing, whereby the rod 46 is protruded to a maximum degree and moved to such a point that the pins 43 and 44 make contact with fixed slant surfaces 47 and 48, respectively. As a result, the yarn is clamped between the movable pins 43 and 44 and the slant surfaces 47 and 48. The clamping force is capable of being varied by regulating the voltage applied to the solenoid.

Thereafter, the traverse drum is rotated at a low speed and a constant torque, and the checking operation shown in FIG. 1 is carried out.

To sum up the foregoing, this invention produces the following excellent effects.

Because the process of this invention comprises the steps of, after splicing yarn ends, taking up the spliced yarn and restraining the spliced yarn on the yarn supply side to impart a predetermined tension to the yarn, detecting whether yarn breakage is brought about, and, if the yarn breakage is not brought about, cutting the spliced yarn, and re-splicing the yarn ends of the yarn thus cut, it is possible by the process to inspect the splicer securely and safely, without providing a separate device.

What is claimed is:

1. In an automatic winder having a splicer for splicing together yarn ends to form a spliced yarn, a process for detecting yarn that is inadequately spliced by the splicer, the process comprising:

taking up the spliced yarn at a predetermined speed, applying a predetermined tension to the spliced yarn, detecting whether the spliced yarn breaks upon application of the predetermined tension, cutting the spliced yarn when the spliced yarn does not break upon application of the predetermined tension to thereby produce cut yarn ends, and splicing together the cut yarn ends.

2. The process of claim 1 wherein the automatic winder functions to wind the yarn at a first speed and wherein the predetermined speed at which the spliced yarn is taken up is lower than the first speed.

3. The process of claim 1 wherein the automatic winder defines a yarn supply side and wherein the step of imparting a predetermined tension to the yarn comprises the step of restraining the yarn on the yarn supply side.

4. In an automatic winder having a rotatable traverse drum and a splicer for splicing together yarn ends to form a spliced yarn, an apparatus for detecting yarn that is inadequately spliced by the splicer, the apparatus comprising:

a control device, the control device comprising an input portion, an output portion and a CPU connected with the input portion and the output portion, the control device having a checking mode for checking the adequacy of splices made by the splicer, a console portion connected to the input portion of the control device for inputting control conditions, checking means, responsive to the control device, for checking the adequacy of splices made by the splicer, and an alarm operated in response to a detected inadequacy of splices made by the splicer.

5. The apparatus according to claim 4, wherein the checking means comprises:

a plurality of fixed pins, a plurality of movable pins, means for moving the moveable pins relative to the fixed pins to thereby bend a yarn disposed between the moveable pins and the fixed pins and thereby impart a tension to the yarn.

6. The apparatus according to claim 5, comprising a support on which at least one of the plurality of fixed pins is located, the support defining fixed slant surfaces, at least two of the plurality of movable pins being arranged on opposing sides of the fixed pin located on the support, whereby a yarn disposed between the moveable pins and the fixed pins is clamped between the movable pins and the slant surfaces.

7. In an automatic winder having a splicer for splicing together yarn ends to form a spliced yarn, an apparatus for detecting yarn that is inadequately spliced by the splicer, the apparatus comprising:

take up means for taking up the spliced yarn at a predetermined speed, tension means for applying a predetermined tension to the spliced yarn, detection means for detecting whether the spliced yarn breaks upon application of the predetermined tension, cutting means for cutting the spliced yarn when the spliced yarn does not break upon application of the predetermined tension to thereby produce cut yarn ends, and splicing means for splicing together the cut yarn ends.

8. The apparatus according to claim 7, wherein the tension means comprises:

a plurality of fixed pins, a plurality of movable pins, means for moving the moveable pins relative to the fixed pins to thereby bend a spliced yarn disposed between the moveable pins and the fixed pins and to thereby apply a predetermined tension to the spliced yarn.

9. The apparatus according to claim 8, comprising a support on which at least one of the plurality of fixed pins is located, the support defining fixed slant surfaces, at least two of the plurality of movable pins being arranged on opposing sides of the fixed pin located on the support, whereby a yarn disposed between the moveable pins and the fixed pins is clamped between the movable pins and the slant surfaces.

10. The apparatus according to claim 8, wherein the automatic winder includes a rotatable traverse drum, further comprising:

a control device, the control device comprising an input portion, an output portion and a CPU connected with the input portion and the output portion, the CPU having a checking mode for actuating the tension means for checking the adequacy of splices made by the splicer, a console portion connected to the input portion of the control device for inputting control conditions, an invertor connected to the output portion of the control device for varying the rotating speed of the traverse drum, and an alarm operated in response to a detected inadequacy of the splicer.

* * * * *